US005883604A

United States Patent [19]

Nicely

[11] Patent Number: 5,883,604

[45] Date of Patent: Mar. 16, 1999

[54] HORN ANTENNA

[75] Inventor: Bernard R. Nicely, Weatherford, Tex.

[73] Assignee: Lockheed Fort Worth Company, Fort Worth, Tex.

[21] Appl. No.: 843,574

[22] Filed: Dec. 11, 1996

Related U.S. Application Data

[63] Continuation of Ser. No. 326,478, Oct. 20, 1994, abandoned.

[51] Int. Cl.[6] ..... H01Q 13/00

[52] U.S. Cl. ..... 343/786; 343/783; 343/785

[58] Field of Search ..... 343/786, 783, 343/785, 772; H01Q 13/00

[56] References Cited

U.S. PATENT DOCUMENTS

| | | | |
|---|---|---|---|
| 3,750,182 | 7/1973 | Kernweis | 343/786 |
| 3,854,141 | 12/1974 | Smith | 343/785 |
| 4,065,772 | 12/1977 | Seavey | 343/786 |
| 5,017,937 | 5/1991 | Newham et al. | 343/786 |

OTHER PUBLICATIONS

Reindel, "A Useful Waveguide for Millimeter Waves", Technical Memorandum, No. EDL–M377, Aug. 1961, p. 21.

*Primary Examiner*—Hoanganh T. Le
*Attorney, Agent, or Firm*—Baker & Botts, L.L.P.

[57] ABSTRACT

Horn antenna (10) produces an electromagnetic energy field and includes waveguide (12) for generating an electromagnetic field having an electric field (52, 54, 56) and magnetic field (58 and 60). Horn portion (14) expands the electric field (52, 54, 56) and magnetic field (50, 60), and produces therefrom an electromagnetic energy field (34) at radiating aperture (29) of horn portion (14). Dielectric portion (32) is positioned within horn portion (14) and includes a sheet (32) of dielectric material that has a relatively uniform thickness. The dielectric portion (32) is placed across horn portion (14) perpendicular to electric field (52, 54, 56) to yield cosinusoidal electromagnetic field (34) at radiating aperture (29).

3 Claims, 4 Drawing Sheets

HORN ANTENNA

CROSS REFERENCE TO RELATED APPLICATIONS

This application is a continuation application of U.S. application Ser. No. 08/326,478, filed on Oct. 20, 1994, and entitled "Horn Antenna," by Bernard R. Nicely, now abandoned.

TECHNICAL FIELD OF THE INVENTION

The present invention relates to radio frequency emitting and receiving devices and, more particularly, to a horn antenna that is economical to build and will accommodate a wide variety of frequencies.

BACKGROUND OF THE INVENTION

A standard horn antenna, as the name suggests, is a radio antenna having the general shape of a horn. The horn antenna produces an electric (E) field that is uniform in the direction of the E field and has constant amplitude across its radiating aperture in that direction. A problem that the uniform field that a standard horn antenna produces is high side lobe levels in the E plane of the electromagnetic field that emits from the antenna. Energy goes into and is needlessly expended in the side lobes. This side lobe energy is wasted and, in some applications, can interfere with main lobe performance. As such, they are generally undesirable. To make the side lobes as small as possible, therefore, reduces energy requirements and eliminates interference for the electromagnetic fields from the antenna.

Some horn antennas use a parabolic reflector to direct or use the energy more efficiently. With a parabolic reflector, however, the side lobes problem still exists. Side lobes that miss the reflector produce unwanted response in directions outside the main lobe and waste energy. The side lobes also cause undesirable main lobe patterns when they hit the parabolic reflector. It is desirable, therefore, to minimize side lobes levels from a horn antenna. The only known way to minimize side lobe levels is to provide a cosinusoidal electromagnetic field distribution in both the electric or E field plane and the magnetic or H field plane.

Known methods to produce a cosinusoidal electromagnetic field distribution are to use a corrugated horn antenna or a scalar feed antenna to taper the electric field portion of the electromagnetic field. Tapering produces side lobes that are approximately 17 to 18 dB down from the peak. Both the corrugated horn antenna and the scalar feed antenna rely on ¼ to ½ wavelength deep corrugations for operation. The corrugated horn antenna has ¼ wavelength corrugations that are cut into the inside wall of horn portion surface in the E plane. This prevents currents from flowing in the horn portion surface. The corrugations present, in essence, an impedance to the surface current that causes the electric field to have a cosinusoidal distribution.

The scalar feed antenna has a circular feed configuration with corrugations built into a radio ground plane that encircles the antenna. The corrugations in the scalar feed antenna are also ¼ wavelength to ½ wavelength deep. Both the corrugated horn antenna and the scalar feed antenna have the limitation of relying on the ¼ or ½ wavelength corrugations. Because of this limitation, operating a conventional horn antenna outside of its design range no longer provides the desired impedance to the electromagnetic field. This can cause main lobe pattern deterioration as well as produce the undesirable side lobe patterns that radiate from the antenna. These effects are both undesirable and uncontrollable.

Known horn antennas are also bulky, of narrow bandwidth, and difficult to build. The wall of the corrugated horn antennas must be thick enough to physically support the ¼ wavelength corrugations that are typically on the order of approximately three inches thick for a radio frequency of 1 GHz. For most of these antennas, a 2:1 bandwidth is the absolute maximum possible bandwidth. These antennas are also hard to build because they must be built in pieces or segments. It is necessary to machine the horn walls, assemble them, and weld them together. In addition, the corrugations must be precisely formed and assembled. If the corrugations are not precisely spaced or of a precise depth, a less than optimal lobe pattern may result.

Another previous problem related to known horn antennas is the fact that an impedance match or minimal voltage standing wave ratio (VSWR) is difficult to achieve. With the corrugated horn antennas, power is reflected back into the antennas where the horn portion starts. This occurs because the electromagnetic wave sees at this point an immediate transition from smooth wall of the antennas wave guide to corrugated wall of the horn portion. A similar problem occurs with the scalar feed antennas.

SUMMARY OF THE INVENTION

Therefore, a need has arisen for an improved horn antenna that is inexpensive to build.

There is a need for a horn antenna that avoids the limitations of conventional horn antenna, including especially the bandwidth limitations of known horn antenna.

There is a further need for an improved horn antenna that is light in weight relative to existing horn antenna.

In accordance with the present invention, a horn antenna is provided that substantially eliminates or reduces disadvantages and problems associated with previously developed horn antenna.

More specifically, the present invention provides a horn antenna for producing a electromagnetic field and that includes a waveguide for generating an electromagnetic field having an electric field and a magnetic field. A horn portion expands the electromagnetic field. A dielectric portion within the horn portion and includes a sheet of dielectric material that has a predetermined uniform thickness. The dielectric portion forms the electromagnetic field a cosinusoidal pattern at the radiating aperture.

A technical advantage of the present invention is that it establishes a desired aperture distribution for a horn antenna without the use of corrugations that preexisting horn antenna require.

Another technical advantage of the present invention provides is a horn antenna that may be manufactured much more economically than can existing horn antenna. Not only can horn antennas be formed according to the concepts of the present invention for use in ground based systems, but also they may be used for airborne and other vehicular electromagnetic frequency systems.

Yet another technical advantage of the present invention is that it provides an antenna with increased bandwidth over known horn antennas.

Still another technical advantage of the present invention is that it may be easily applied to existing horn antennas that do not already possess corrugations or other types of electromagnetic field distribution controlling devices. By forming the dielectric portion in the horn portion of an existing horn antenna so that the electric field is properly modified, the present invention yields a horn antenna with the desired cosinusoidal aperture distribution.

BRIEF DESCRIPTION OF THE DRAWINGS

For a more complete understanding of the present invention and the advantages thereof, reference is now made to the following description which is to be taken in conjunction with the accompanying drawings in which like reference numerals indicate like features and wherein.

DETAILED DESCRIPTION OF THE INVENTION

Preferred embodiments of the present invention are illustrated in the FIGUREs like numerals being used to refer to like and corresponding parts of the various drawings.

Figure 1:
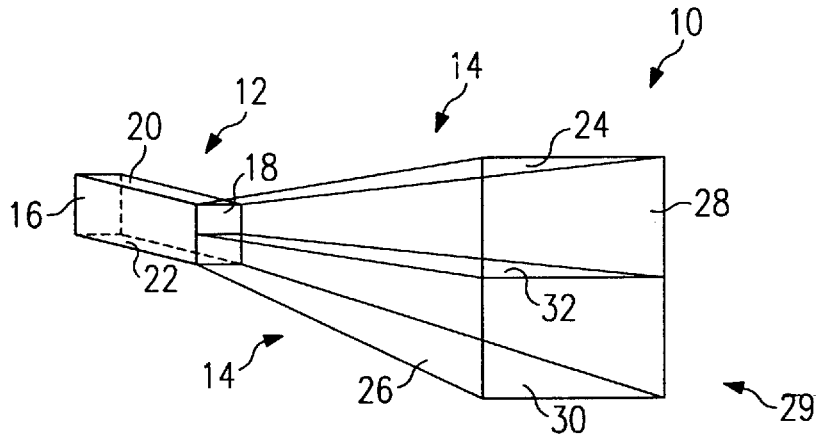
FIG. 1 shows an isometric view of one embodiment of the present invention.

FIG. 1 illustrates horn antenna 10 that includes waveguide 12 and horn portion 14. Waveguide 12 has the form of an elongated parallelepiped including sidewalls 16 and 18 and upper wall 20 and lower wall 22. Each of the walls of waveguide 12 associate with a wall of horn portion 14. Thus, upper wall 20 connects to upper wall 24 of horn portion 14, sidewalls 16 and 18 connect, respectively, to sidewalls 26 and 28, and lower wall 22 of waveguide 12 connects to lower wall 30 of horn portion 14. Attached to sidewalls 26 and 28 and equidistant from upper wall 24 and bottom wall 30 of horn portion 14 is dielectric material 32.

Figure 2:
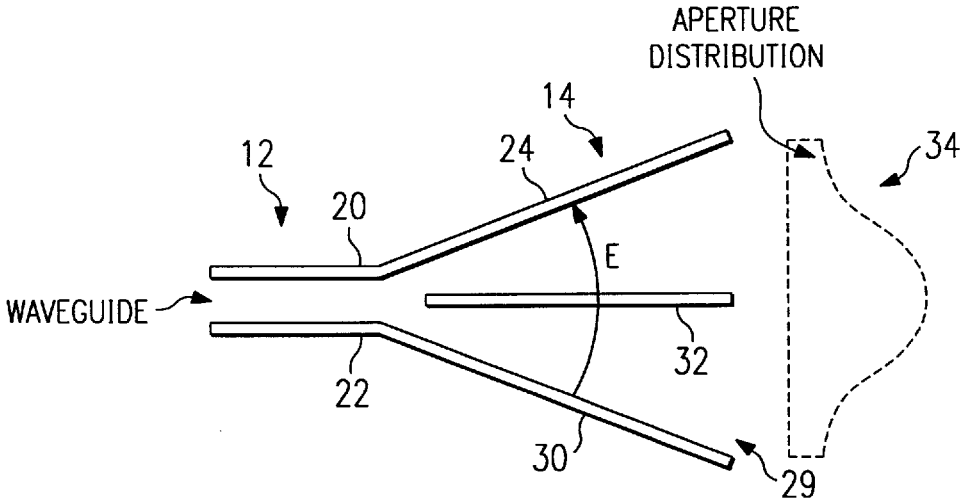
FIG. 2 illustrates a cross sectional view of the horn antenna according to the FIG. 1 embodiment.

The addition of dielectric material 32 provides a desirable aperture distribution in the present embodiment. In particular, as FIG. 2 illustrates, waveguide 12 with upper wall 20 and lower wall 22 forms a continuous surface with upper wall 24 and lower wall 26 of horn portion 14. As FIG. 2 illustrates, dielectric sheet 32 is positioned within the E field of horn portion 14. This produces the desired aperture distribution 34 of FIG. 2.

Figure 3:
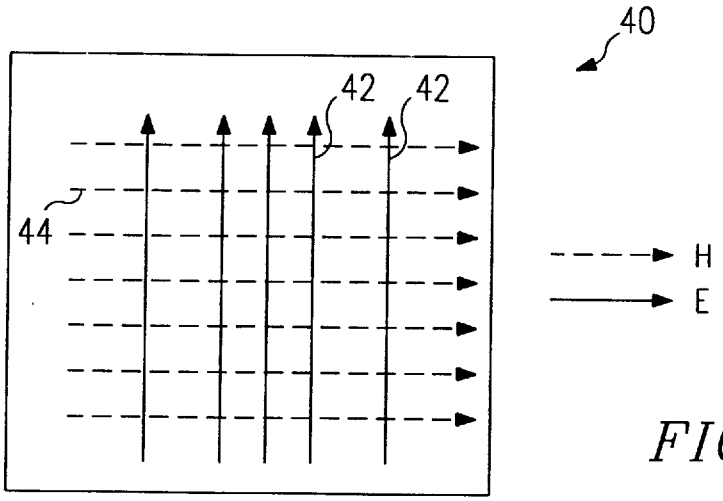
FIG. 3 shows the $TE_{10}$ fundamental mode output formed by a conventional horn antenna without electric field modification that the present embodiment provides.
Figure 4:
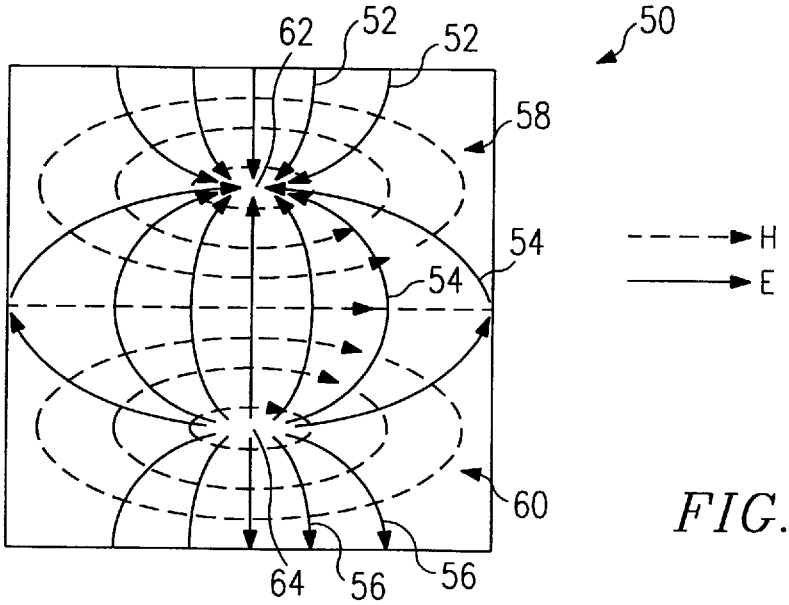
FIG. 4 depicts the $TM_{12}$ mode that the present embodiment forms.

FIG. 3 illustrates a mode diagram 40 for the $TE_{10}$ transmission mode in the absence of dielectric sheet 32. That is, $TE_{10}$ mode diagram 40 illustrates the electric field E and magnetic field H that would appear at radiating aperture 29 of horn antenna 10 in the absence of dielectric material 32. Thus, solid E field lines 42 have a vertical direction. The H field, as dash lines 44 illustrate, has a horizontal orientation or, equivalently, perpendicular orientation to the E field. FIG. 4 shows the $TM_{12}$ mode diagram 50 that appears in the presence of dielectric material 32 in horn antenna 10. Thus, solid lines 52, 54, and 56 illustrate the intensity distribution of the E field at radiating aperture 29. Dielectric material 32 causes distortion in the E field which generates distortion in the H field as concentric dash lines 58 and 60 illustrate in the $TM_{12}$ mode. The distortion that dielectric material 32 produces causes the bell-shaped aperture distribution 34 of FIG. 2 by combination of the $TM_{12}$ mode and the $TE_{10}$ mode in the proper amounts and phase at the radiating aperture 29.

The H field for the transverse magnetic modes have concentric elliptical field patterns which are identically and symmetrically split about the E field.

The H fields of FIG. 4 are concentric in that they grow stronger near E field focus points 62 and 64. As a result, the field intensity forms a curved shape with an intensity distribution out of the page. The E fields in $TM_{12}$ mode diagram 50 focus their strength at focus points 62 and 64 and form a curved shape.

Figure 5:
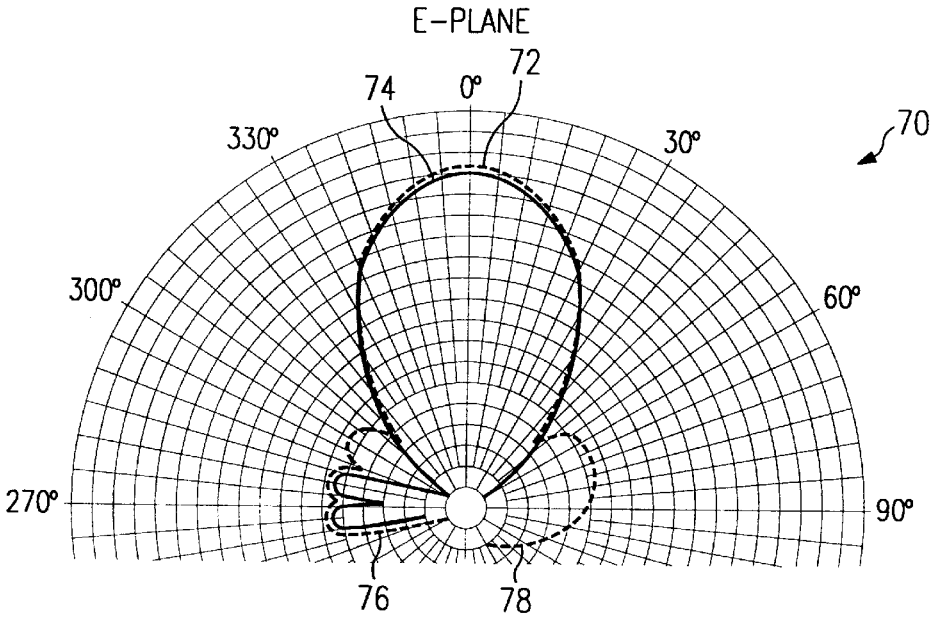
FIGS. 5 and 6 show E plane and H plane field patterns, respectively, formed by the present embodiment at a 10 GHz frequency.
Figure 6:
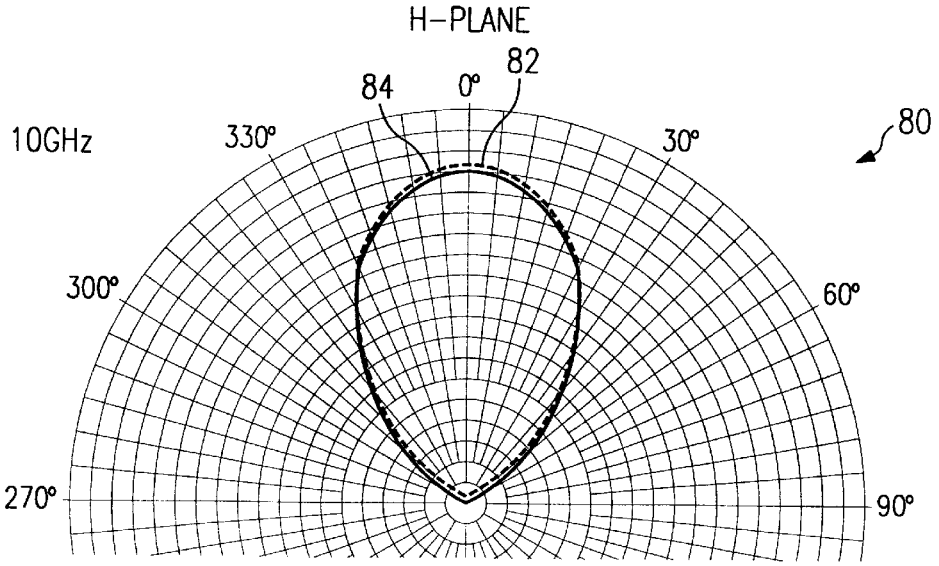

FIG. 5 includes plot 70 which shows as dash line 72 the E plane lobe configuration that horn antenna 10 produces at 10 GHz without dielectric material 32 in horn antenna 10. Solid line 74 indicates the lobe pattern for the E plane in the presence of dielectric material 32. As FIG. 5 indicates, substantial side lobes 76 and 78 arise in the absence of dielectric material 32 at the 10 GHz frequency. FIG. 6 shows, however, that the presence of dielectric material in horn antenna 32 does not significantly affect the H plane at a 10 GHz frequency. Thus, as the H plane plot 80 indicates, dash lines 82, which indicate the H plane configuration in the absence of dielectric material 32 forms a lobe pattern essentially equivalent to the solid line 84 lobe pattern. Lobe pattern 84 is that which arises when dielectric material 32 is present in horn antenna 10. As FIG. 5 illustrates, the side lobe levels are approximately 18 dB down from the main lobe pattern.

Figure 7:
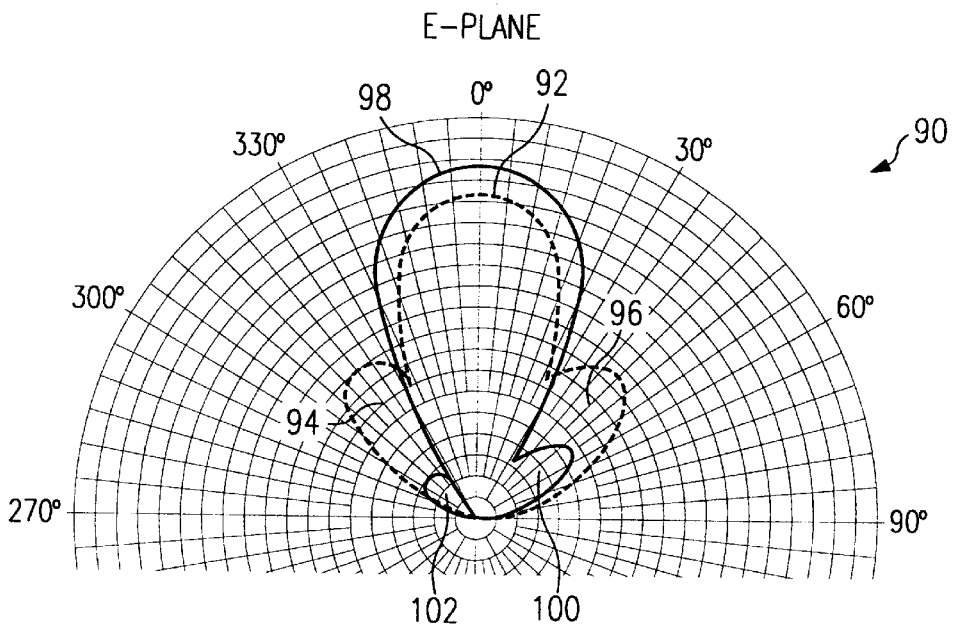
FIGS. 7 and 8 show E plane and H plane field patterns, respectively, formed by the present embodiment at a 16 GHz frequency.
Figure 8:
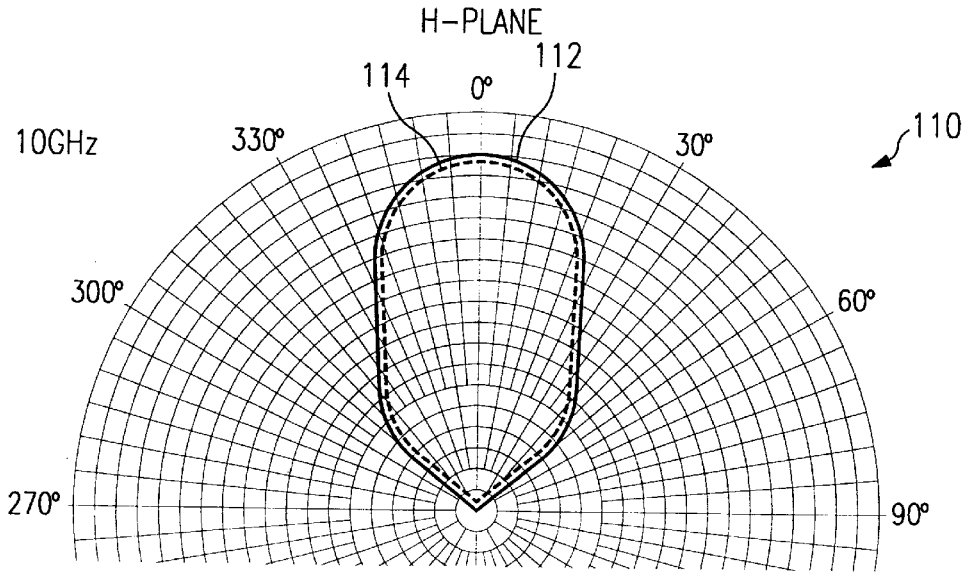

FIGS. 7 and 8 are similar to FIGS. 5 and 6 and show the effect on the lobe patterns that exist both with and without dielectric material 32 when horn antenna 10 frequency increases. Referring to FIG. 7, plot 90 shows with dash lines 92 that even more substantial side lobes 94 and 96 exist in the absence of dielectric material 32. With dielectric material 32 present, as solid line 98 illustrates, side lobes 100 and 102 are significantly smaller. FIG. 8 shows in plot 110, again, that the H plane diagram 112 for the horn antenna 10 without dielectric material 32 is essentially identical to the H plane diagram 114 that arises dielectric material 32 is absent from horn antenna 10. FIG. 7, therefore, shows that at 16 GHz the side lobe levels are 12 dB and 13 dB down from the main lobe. With dielectric material 32 in horn portion 14, side lobes drop to approximately 20 dB down. Thus, with greater frequencies, dielectric material 32 more significantly reduces side lobes on the electromagnetic field distribution at radiating aperture 29. Conversely, as the electromagnetic frequency decrease, the E plane lobe patterns with and without dielectric material 32 begin to overlay one another and become less distinguishable.

The present embodiment has application to several different types of horn antennas, whether horn portion 14 is exponential or smooth shaped in the E plane. Dielectric sheet 32 preferably possesses a low dielectric constant, such as that of a Teflon impregnated fiberglass. One example of such a material is that having the trademark Duroid® that is sold by the Rogers Corporation. Depending on the desired dielectric constant, dielectric material 32 may be of different thicknesses to achieve a desired amount of the $TM_{12}$ mode operation. As a further example, for a typical 6 to 18 GHz horn, the thickness of dielectric material 32 may be approximately 0.060 inches. Such a thickness is sufficient to intercept enough of the E field to establish the $TM_{12}$ mode of operation.

The desired $TM_{12}$ mode of operation, therefore, adds to the $TE_{10}$ mode in the-present embodiment for the desired radiating aperture 29 distribution 34. A higher dielectric constant permits the thickness of dielectric material 32 to decrease. In the center of radiating aperture 29, the vectors from the $TE_{10}$ mode and those of the $TM_{12}$ mode are in phase. At the outer edge of radiating aperture 34, however, the vectors are out of phase. This reduces the total E field at the outer edges and produces the desired cosinusoidal distribution output 34. A cosinusoidal aperture distribution occurs naturally in the H plane from the fundamental $TE_{10}$ mode field variation. Because dielectric material 32 affects the E field, therefore, a cosinusoidal aperture distribution occurs in both planes which is highly desirable and results in low side lobe levels.

In addition to forming the desired cosinusoidal distribution 34, horn antenna 10 of the present embodiment minimizes the voltage standing wave ration (VSWR) that exists between waveguide 12 and horn portion 14. Because of the corrugations that attach to a corrugated horn antenna or a scalar field antenna, as the electromagnetic field enters the horn portion of those antennas, it experiences significant impedance and signal distortion due to reflective properties of the corrugations. Since the present embodiment of horn antenna 10 includes no such corrugations, a substantial reduction in the VSWR results. This even further improves the operational characteristics from horn antenna 10.

Attractive features of horn antenna 10 of the present embodiment, therefore, are that there are no bandwidth limitations. For example, a broadband horn antenna with a 10:1 bandwidth without the dielectric material 32 still possesses 10:1 bandwidth operational capability. When frequency decreases, the effect of the dielectric simply diminishes by reducing the effect of the E plane on the side lobes. As a result, where there is a need to have a single parabola that operates from very low frequencies (e.g., 6 GHz up to 16 GHz) the present embodiment permits instantaneous changes in lobe characteristics without having to change the horn antenna. The present embodiment produces a significant level of the $TM_{12}$ mode in combination with the dominant $TE_{10}$ mode to yield the desired cosinusoidal electromagnetic field distribution.

In summary, the present invention provides a horn antenna that includes a waveguide for generating an electromagnetic field having an electric field and a magnetic field. A horn portion expands the electromagnetic field and produces therefrom a cosinusoidal electromagnetic field distribution at a radiating aperture. A dielectric portion is positioned within the horn portion and includes a sheet of dielectric material. The dielectric portion is placed across the horn portion perpendicular to the electric field to yield a cosinusoidal electromagnetic field at the radiating aperture.

Although the invention has been described in detail herein with reference to the illustrative embodiments, it is to be understood that this description is by way of example only and is not to be construed in a limiting sense.

For example, the following exemplary modification is well within the scope of the present invention. A horn antenna may be formed using the concepts of the present invention that generates a dual polarized electromagnetic field. Thus, by forming dielectric portion having a dielectric material layer that is perpendicular to the E field in both the X direction and the Y direction, a dual polarized electromagnetic field results that is cosinusoidal in both the horizontal and vertical planes.

Furthermore, a system using any number of horn antennas such as the horn antenna 10 of FIG. 1 may be used and still be well within the scope of the present invention. It is to be further understood, therefore, that numerous other changes in the details of the embodiments of the invention and additional embodiments of the invention, will be apparent to, and may be made by, persons of ordinary skill in the art having reference to this description. It is contemplated that all such changes and additional embodiments are within the spirit and true scope of the invention as claimed below.

What is claimed is:

1. A method for producing a cosinusoidal electromagnetic field from a horn antenna, comprising the steps of:

generating an electromagnetic field comprising an electric field and a magnetic field in a waveguide of the horn antenna;

amplifying the electric field and magnetic field in a horn portion of the horn antenna;

directing the electric field and magnetic field in a predetermined direction using the horn portion of the horn antenna; and passing the electric field through a dielectric material positioned transverse to the electric field, said dielectric material having a thickness of approximately 0.060 inches and operable to distort the electric field, in turn distorting the magnetic field, to produce a cosinusoidal electromagnetic field at a radiating aperture of the horn antenna.

2. A horn antenna for generating a cosinusoidal electromagnetic field, comprising:

a waveguide for generating an electromagnetic field comprising an electric field and a magnetic field;

a horn portion for expanding said electromagnetic field and directing said electromagnetic field in a predetermined direction and further comprising a radiating aperture; and a dielectric portion positioned within said horn portion, the dielectric portion comprising a sheet of a dielectric material having a thickness of approximately 0.060 inches and operable to distort the electric field, in turn distorting the magnetic field, for producing a cosinusoidal electromagnetic field at said radiating aperture.

3. A system for producing cosinusoidal electromagnetic fields across an wide bandwidth, comprising:

a variable frequency source for generating a plurality of electrical signals;

a horn antenna for generating a cosinusoidal electromagnetic field from at least one of said plurality of electrical signals, said horn antenna, comprising:

a waveguide for generating an electromagnetic field from said electrical signal;

a horn portion for expanding said electromagnetic field and directing said electromagnetic field in a predetermined direction and further comprising a radiating aperture; and a dielectric portion positioned within said horn portion, said dielectric portion comprising a dielectric material sheet having a thickness of approximately 0.060 inches and operable to influence the electric field, thereby influencing the magnetic field, for producing a cosinusoidal electromagnetic field at said radiating aperture.

* * * * *